US010496034B2

(12) United States Patent
Takano et al.

(10) Patent No.: US 10,496,034 B2
(45) Date of Patent: Dec. 3, 2019

(54) IMAGE FORMING APPARATUS

(71) Applicant: CANON KABUSHIKI KAISHA, Tokyo (JP)

(72) Inventors: Hiroki Takano, Abiko (JP); Tomofumi Kawamura, Suntou-gun (JP); Shoichi Zensai, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 29 days.

(21) Appl. No.: 15/794,284

(22) Filed: Oct. 26, 2017

(65) Prior Publication Data

US 2018/0120763 A1 May 3, 2018

(30) Foreign Application Priority Data

Nov. 1, 2016 (JP) ..... 2016-214489
Sep. 19, 2017 (JP) ..... 2017-179418

(51) Int. Cl.
*G03G 21/18* (2006.01)
*G03G 15/08* (2006.01)
*G03G 21/16* (2006.01)

(52) U.S. Cl.
CPC ..... *G03G 21/1842* (2013.01); *G03G 15/0865* (2013.01); *G03G 21/1633* (2013.01); *G03G 21/1821* (2013.01); *G03G 2221/1654* (2013.01); *G03G 2221/1853* (2013.01)

(58) Field of Classification Search
CPC ..... G03G 21/1633; G03G 21/1842; G03G 2221/1884
See application file for complete search history.

(56) References Cited

U.S. PATENT DOCUMENTS

2006/0018671 A1* 1/2006 Kamimura ..... G03G 21/1896 399/13
2009/0028601 A1* 1/2009 Mizuno ..... G03G 21/185 399/111
2011/0299873 A1* 12/2011 Ushiozu ..... G03G 15/04054 399/90
2014/0093257 A1* 4/2014 Seto ..... G03G 21/1892 399/25
2017/0160697 A1* 6/2017 Sato ..... G03G 21/1633

FOREIGN PATENT DOCUMENTS

JP 3535604 B2 6/2004
JP 6787490 B2 9/2015

OTHER PUBLICATIONS

U.S. Appl. No. 15/794,273, filed Oct. 26, 2017 (First Named Inventor: Shoichi Zensai).

* cited by examiner

*Primary Examiner* — Thomas S Giampaolo, II
(74) *Attorney, Agent, or Firm* — Venable LLP

(57) ABSTRACT

An apparatus includes an opening/closing member that opens/closes space which is provided in an apparatus body and in which a first unit and a second unit are accommodated; a first guide portion that guides the first unit in the space; a second guide portion that guides the second unit in the space; and a slope member that is capable of guiding the first unit to the first guide portion provided at a position higher than a position of the second guide portion in a height direction orthogonal to an inserting/extracting direction of the space when the opening/closing member is put in an open position, the slope member being coupled between the apparatus body and the opening/closing member so as to be positioned in the space when the opening/closing member is put in a closed position to close the space.

11 Claims, 14 Drawing Sheets

UPPER SIDE OF APPARATUS
FRONT SIDE OF APPARATUS 94
80
34f
34e
35h
31h
35j
35
102
34
33
32
31
30
29
28
31e
θ
L

IMAGE FORMING APPARATUS

BACKGROUND OF THE INVENTION

Field of the Invention

The present invention relates to an image forming apparatus using an electrophotographic system.

Description of the Related Art

In image forming apparatuses using an electrophotographic system such as copiers, printers, facsimile machines, and multifunction peripherals including copiers, printers, and facsimile machines, it has been known to use a process cartridge system in which photosensitive drums and processing means acting on the photosensitive drums are unitized as integral cartridges and made attachable/detachable to/from apparatus bodies. In the image forming step of an image forming apparatus, light such as laser light, LED light, and lamp light corresponding to image information is irradiated onto a photosensitive drum to form an electrostatic latent image thereon. Then, the electrostatic latent image is developed by a developing apparatus, and a developer image formed on the photosensitive drum is transferred onto a recording material to form an image thereon. In the above step, when attached to an apparatus body, a cartridge (unit) needs to expose its position at which the photosensitive drum opposes the recording material and its portion at which the photosensitive drum opposes body-side processing means acting on the photosensitive drum. In the replacement of the cartridge, the cartridge needs to be inserted so as not to contact the apparatus body to prevent damage on the surface of the photosensitive drum.

In view of the above problems, there has been proposed, as a method for inserting a cartridge, a configuration in which a rib serving as an inserting/extracting guide is provided on a door that opens/closes the opening portion of an image forming apparatus for replacement and the cartridge is mounted on the rib to be attached (Japanese Patent No. 5787490). Besides, there has been proposed a configuration in which a protection cover removable in a longitudinal direction is provided on a cartridge, a convex portion provided at the tip lower portion in the inserting direction of the protection cover is fitted in the concave portion of an image forming apparatus body, and the cartridge is guided in a state of being attached (Japanese Patent No. 3535604).

However, in the configuration in which the cartridge is attached in a state of being mounted on the rib, the height of the cartridge with respect to an apparatus body is made substantially the same between a state in which the cartridge is attached inside the image forming apparatus and a state in which the cartridge is mounted on the rib. Accordingly, in a configuration in which a photosensitive drum is exposed to the upper side of the cartridge, there is a likelihood that the cartridge contacts the apparatus body and damages the surface of the photosensitive drum when the cartridge is isolated from the rib.

Further, in the configuration in which the cartridge is guided by the protection cover to be attached, there is a concern that the function of guiding the cartridge is lost when a user erroneously removes the protection cover before attaching the cartridge to the apparatus body.

It is an object of the present invention to provide a technology capable of preventing the occurrence of damage or the like on members constituting a unit in a configuration in which the unit is made attachable/detachable to/from an image forming apparatus body.

SUMMARY OF THE INVENTION

In order to achieve the above object, an embodiment of the present invention provides an image forming apparatus including: an apparatus body; a first unit and a second unit that are configured to be attachable/detachable to/from the apparatus body; an opening/closing member that opens/closes space which is provided in the apparatus body and in which the first unit and the second unit are accommodated; a first guide portion that is provided in the apparatus body and guides the first unit in the space; a second guide portion that is provided in the apparatus body and guides the second unit in the space; and a slope member that is capable of guiding the first unit to the first guide portion provided at a position higher than a position of the second guide portion in a height direction orthogonal to an inserting/extracting direction of the space when the opening/closing member is put in an open position, the slope member being coupled between the apparatus body and the opening/closing member so as to be positioned in the space when the opening/closing member is put in a closed position to close the space.

In addition, in order to achieve the object, an embodiment of the present invention provides an image forming apparatus including: an apparatus body; a first unit that is configured to be attachable/detachable to/from the apparatus body; a second unit that is configured to be attachable/detachable to/from the apparatus body; a first guide portion that is provided in the apparatus body and guides the first unit to a first attachment position of the apparatus body; and a second guide portion that is provided in the apparatus body and guides the second unit to a second attachment position of the apparatus body, wherein the first guide portion and the second guide portion are different in height in a vertical direction of the apparatus body.

Further features of the present invention will become apparent from the following description of exemplary embodiments (with reference to the attached drawings).

BRIEF DESCRIPTION OF THE DRAWINGS

FIG. 1A shows the image forming apparatus with an access door closed. FIG. 1B shows the image forming apparatus with the access door open.

FIG. 3A is a bottom side perspective view of the process cartridge. FIG. 3B is an upper side perspective view of the process cartridge. FIG. 3C is a perspective view of a development unit of the process cartridge, and FIG. 3D is a perspective view of a drum unit of the process cartridge.

FIG. 5A is a perspective view of the driving unit of the contact/separation means, and FIG. 5B is a detailed perspective view of the driving unit of the contact/separation means shown in FIG. 5A. FIG. 5C is a schematic cross-sectional view of a process cartridge and the contact/separation means during development contact, and FIG. 5D is a schematic cross-sectional view of the process cartridge and the contact/separation means during development separation.

FIG. 6A is a perspective view showing the biasing configuration of one station during development contact, and FIG. 6B is a perspective view of the biasing configuration shown in FIG. 6A in which a slider is removed for illustrative purposes. FIG. 6C is a perspective view of the apparatus shown in FIG. 6A showing the back sides of components on the rear side. FIG. 6D is a perspective view of the apparatus shown in FIG. 6A showing a configuration during development separation as opposed to the development contact shown in FIG. 6A.

FIG. 7A is a partially enlarged view of the apparatus when seen from the front side during development contact, and FIG. 7B is a partially enlarged view of FIG. 7A in which the relationship between the contact/separation means and a rib of the development unit is shown from the upper side of the apparatus. FIG. 7C is a partially enlarged view of the apparatus when seen from the front side during development separation, and FIG. 7D is a partially enlarged view of FIG. 7A in which the relationship between the contact/separation means and a rib of the development unit is shown from the upper side of the apparatus.

FIG. 8A is a partially enlarged cross-sectional views of the apparatus when seen from the right side, showing a state in which the access door is in a closed position. FIG. 8B is the view shown in FIG. 8A showing a state in which the access door is in an open position.

FIG. 9A is an enlarged view of a front side of a K-station showing the access door closed. FIG. 9B is the enlarged view of the K-station shown in FIG. 9A shown with the access door open.

FIG. 10A shows a state in which the access door is open, and FIG. 10B shows a state in which the access door is closed.

FIG. 12A shows a state in which the access door is closed, and FIG. 12B shows a state in which the access door is open.

DESCRIPTION OF THE EMBODIMENTS

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

First Embodiment

Examples of an image forming apparatus to which the present invention is applicable include a copier, a printer, a facsimile machine, a multifunction peripheral including a copier, a printer, and a facsimile machine, or the like that forms an image on a recording material using an electrophotographic system. Here, a description will be given of a case in which the present invention is applied to a color laser printer. An image forming apparatus according to this embodiment is a full color laser beam printer of four colors using an electrophotographic process, and forms a color image on a recording material such as a paper. Further, the image forming apparatus is a process cartridge attachable/detachable type in which first to fourth (four) process cartridges are detachably attached to an image forming apparatus body to be used.

Here, in the image forming apparatus, a front side or a near side indicates a side on which an access door 101 is disposed. A rear side or a back side indicates a side opposite to the front side or the near side. A front-back direction indicates a direction from the rear side to the front side (a forward direction or a front direction) and its opposite direction (a backward direction or a rear direction). Right and left sides indicate right and left sides when the image forming apparatus is seen from the front side. A right-left direction indicates a direction from the right side to the left side (left direction) and its opposite direction (right direction). The front-back direction and the right-left direction indicate directions parallel to a horizontal direction, and a height direction indicates a vertical direction, i.e., a direction orthogonal to the front-back direction and the right-left direction. Further, the image forming apparatus body indicates a constituent part of the image forming apparatus other than the process cartridges. Further, with respect to the process cartridges or their constituent members or constituent members on the side of the apparatus body, a longitudinal direction indicates the axis direction of electrophotographic photosensitive drums 1 serving as image bearing members or a direction parallel to the axis direction.

Image Forming Apparatus

Figure 1B:
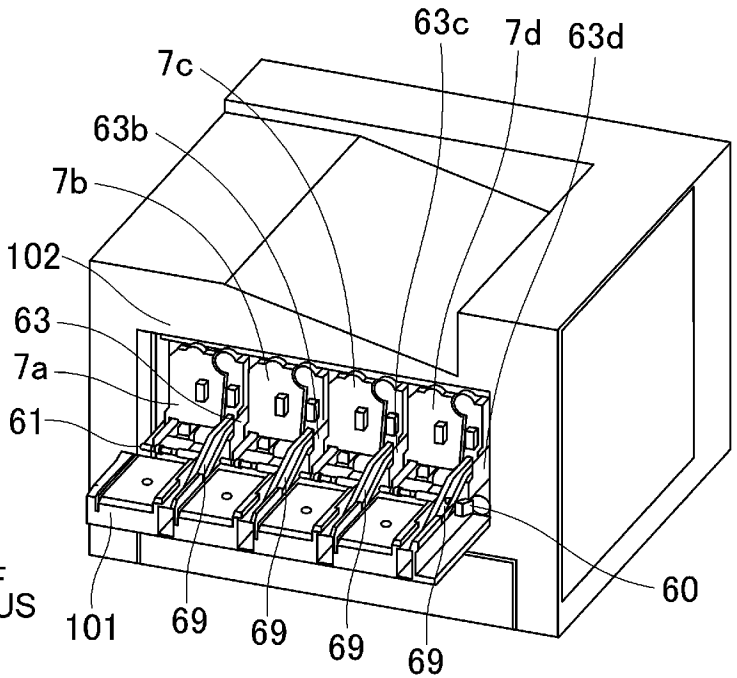
FIGS. 1A and 1B are schematic perspective views of an image forming apparatus according to a first embodiment of the present invention.
Figure 1A:
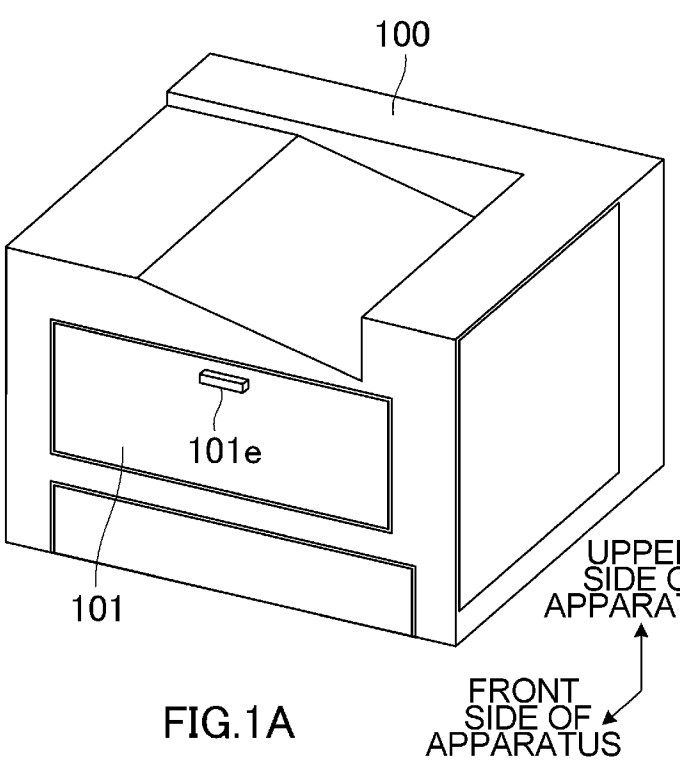

FIGS. 1A and 1B are schematic perspective views of a printer 100 serving as an image forming apparatus to which process cartridges 7 (cartridges) are attachable/detachable to/from the image forming apparatus body (apparatus body). FIG. 1A is a view in a state in which the access door 101 for opening/closing an opening portion provided in the apparatus body to replace the cartridges 7 is closed. FIG. 1B is a view in a state in which the access door 101 is open, and the cartridges 7 may be extracted in the front direction of the apparatus when the access door 101 is open.

Figure 2:
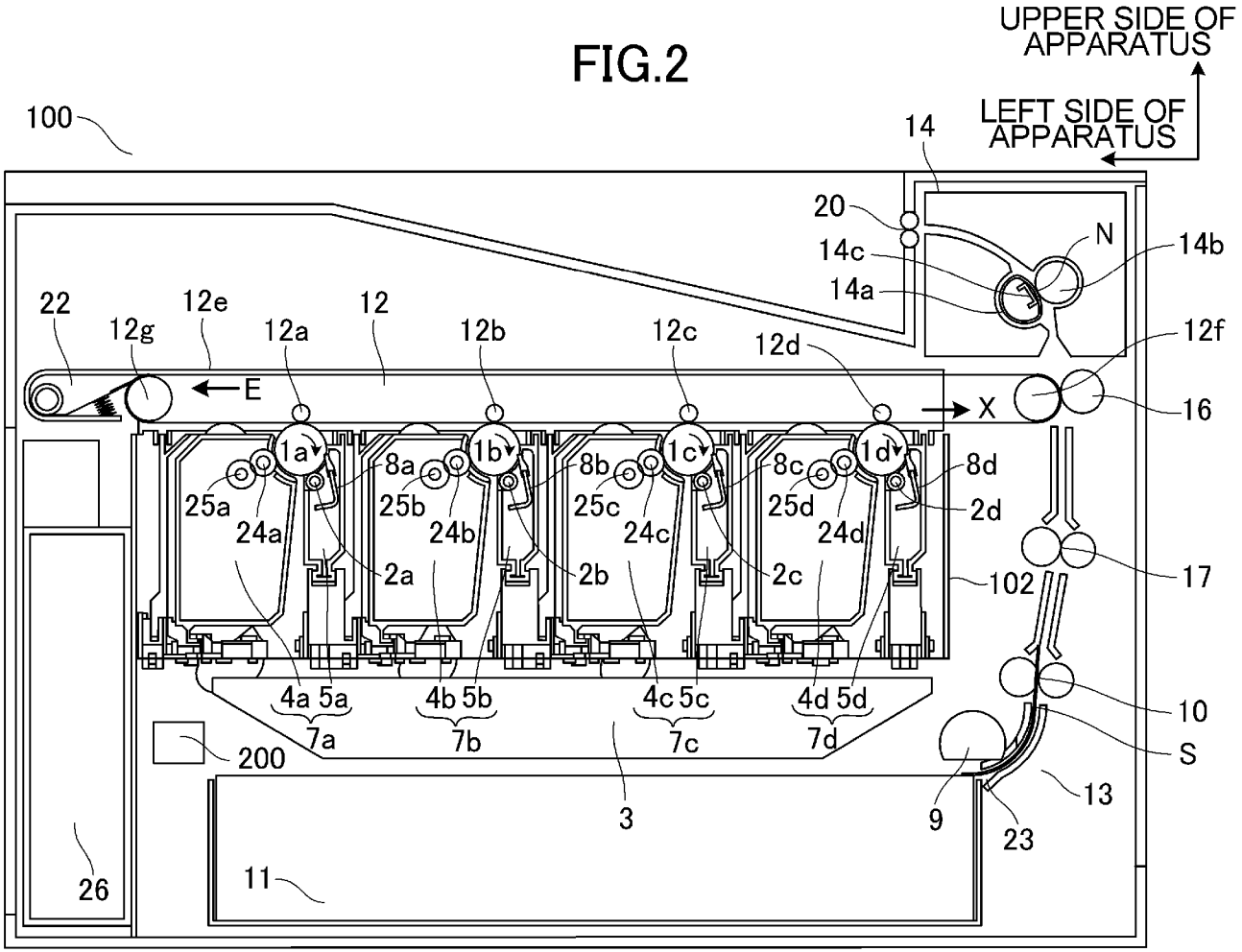
FIG. 2 is a schematic cross-sectional view of the image forming apparatus according to the first embodiment of the present invention.

FIG. 2 is a schematic cross-sectional view of the printer 100 when seen from the front side. At the bottom of the printer 100, a cassette 11 is accommodated so as to be capable of being extracted. Transfer materials S serving as recording materials are accommodated in the cassette 11 in a stacked state, and separated one by one to be fed. The printer 100 has the cartridges 7 (7*a*, 7*b*, 7*c*, 7*d*) corresponding to the respective colors of yellow (Y), magenta (M), cyan (C), and black (K) as image forming means provided side by side in a line. Each of the cartridges 7 is constituted by the two bodies of a development unit 4 (4*a*, 4*b*, 4*c*, 4*d*) and a drum unit (cleaner unit) 5 (5*a*, 5*b*, 5*c*, 5*d*) having a photosensitive drum. In general, toner may be quickly exhausted or photosensitive drums may be quickly exhausted depending on user's printing contents. That is, a timing at which the replenishment of toner (the replacement of development units) is needed does not necessarily match a timing at which the replacement of photosensitive drums (the replacement of drum units) is needed. In the embodiment, the cartridge 7 is constituted by the two bodies, i.e., the development unit 4 and the drum unit 5 are separately replaceable at a second attachment position and a first attachment position, respectively. Thus, it becomes possible to reduce printing costs and save resources from a user's point of view.

In the cartridge 7, the drum unit 5 has a photosensitive drum 1 (1*a*, 1*b*, 1*c*, 1*d*) serving as an image bearing member and a charging apparatus 2 (2*a*, 2*b*, 2*c*, 2*d*) that uniformly negatively charges the surface of the photosensitive drum 1. Further, the drum unit 5 has a cleaning blade 8 (8*a*, 8*b*, 8*c*, 8*d*) that removes residual toner on the photosensitive drum 1 after the transfer of a toner image and a toner container in which untransferred toner is accommodated.

In the development unit 4, a development roller (24*a*, 24*b*, 24*c*, 24*d*) serving a as developer bearing member and a developer coating roller 25 (25*a*, 25*b*, 25*c*, 25*d*) are rotatably supported by a frame body serving also as a toner accommodating container. The development roller 24 plays a role in attaching toner to an electrostatic latent image formed on the surface of the photosensitive drum 1 and developing the resultant image as a toner image (developer image). The development roller 24 is biased so as to be pressed against the surface of the photosensitive drum 1 at the contact position between the development roller 24 and the photosensitive drum 1 to attach the toner.

Here, in the present application specification, a contact position indicates a development position at which it is possible to attach toner to an electrostatic latent image on the photosensitive drum 1 to form a toner image, and indicates a position at which the development roller 24 contacts the photosensitive drum 1 or a position at which the development roller 24 comes close to the photosensitive drum 1. That is, the development roller 24 may not contact the photosensitive drum 1 so long as the contact position is a position at which toner is attached to an electrostatic latent image on the photosensitive drum 1 to form a toner image (in this case, the position is also called the contact position for the sake of convenience).

Figure 3A:
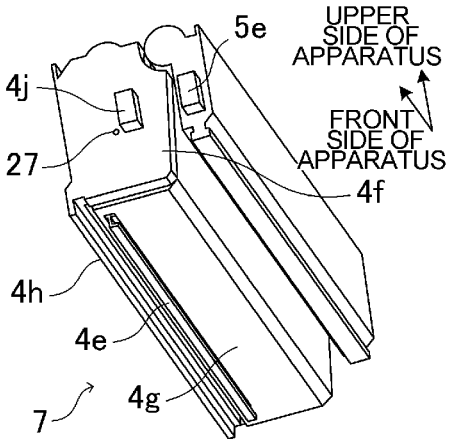
FIGS. 3A to 3D are schematic perspective views of a process cartridge according to the first embodiment of the present invention.
Figure 3B:
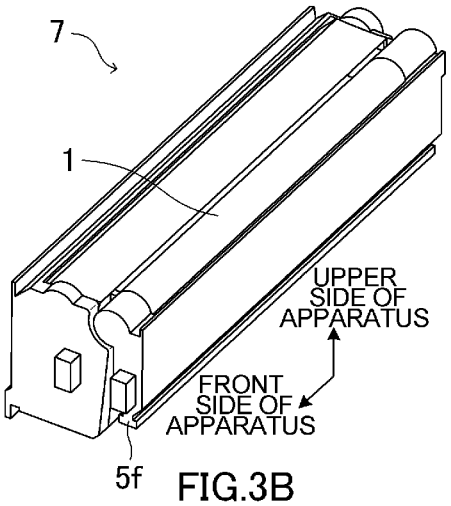
Figure 3C:
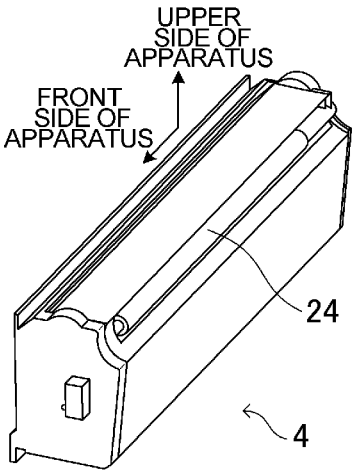
Figure 3D:
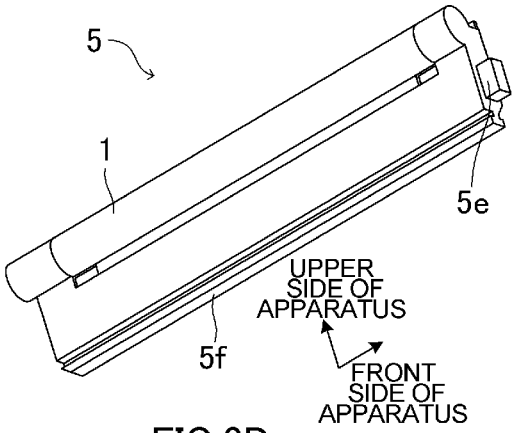

FIGS. 3A to 3D are schematic perspective views of the process cartridge 7 having the two bodies of the development unit 4 and the drum unit 5 in the embodiment. FIGS. 3A and 3B are views showing a state in which the development unit 4 and the drum unit 5 are arranged so as to act on each other to form an image as in image formation. FIG. 3C is a perspective view of the development unit 4, and FIG. 3D is a perspective view of the drum unit 5. The frame body of the development unit 4 is roughly constituted by a development frame 4*f* and a development container 4*g*, and the development frame 4*f* and the development container 4*g* are configured to be capable of swinging each other with a pin 27 as a swinging center. Thus, the development roller 24 is configured to be capable of contacting and separating from the photosensitive drum 1 (the development roller 24 is movable between a contact position and a separating position). The development unit 4 and the drum unit 5 are provided with handle portions 4*j* and 5*e*, respectively.

With this configuration, the development roller 24 is caused to contact the photosensitive drum 1 in synchronization with a timing at which toner is attached to an electrostatic latent image formed on the photosensitive drum 1 to be developed (contact state). In a period other than the timing, the development roller 24 is caused to separate from the photosensitive drum 1 to a greater extent (standby state), whereby the service lives of the development roller 24 and the photosensitive drum 1 are extended. A scanner unit 3 that irradiates a laser beam based on image information to form an electrostatic latent image on the photosensitive drum 1 is provided beneath the process cartridge 7, and an intermediate transfer unit 12 is provided on the process cartridge 7.

The intermediate transfer unit 12 has primary transfer rollers 12*a*, 12*b*, 12*c*, and 12*d*, an endless cylindrical intermediate transfer belt 12*e*, a driving roller 12*f*, a tension roller 12*g*, and a cleaning apparatus 22 that removes toner on the intermediate transfer belt 12*e*. The cleaning apparatus 22 is arranged on the upstream side of a primary transfer part formed by the photosensitive drum 1*a* and a primary transfer roller 12*a* in the movement direction of the intermediate transfer belt 12*e* (in an arrow E direction in FIG. 2). In addition, the cleaning apparatus 22 is arranged on the downstream side of a secondary transfer part 15 formed by a driving roller 12*f* and a secondary transfer roller 16.

Moreover, the cleaning apparatus 22 is positioned and held by the shaft of the tension roller 12*g*, and configured to follow a change in the position of the tension roller 12*g*. Further, since the intermediate transfer belt 12*e* and the cleaning apparatus 22 are consumable items, the intermediate transfer unit 12 integrated with the cleaning apparatus 22 is made attachable/detachable to/from the apparatus body. Further, untransferred toner on the intermediate transfer belt 12*e* collected by the cleaning apparatus 22 is accumulated in a toner collecting container 26 arranged inside the printer 100.

When the driving roller 12*f* is rotationally driven by a driving source such as a motor (not shown), the intermediate transfer belt 12*e* rotates at a prescribe speed in an arrow X direction in FIG. 2. In primary transfer, a positive bias voltage is applied to the primary transfer rollers 12*a*, 12*b*, 12*c*, and 12*d* and a potential difference with the surfaces of the negatively-charged photosensitive drums 1 is used, whereby toner is transferred from the photosensitive drums 1 onto the intermediate transfer belt 12*e* (primary transfer).

At respective primary transfer parts formed by the primary transfer rollers 12*a*, 12*b*, 12*c*, and 12*d* and the photosensitive drums 1 in the respective image forming stations of the colors Y, M, C, and K, toner images on the photosensitive drums 1 are primarily transferred onto the intermediate transfer belt 12*e* in a stacked state. The toner images transferred onto the intermediate transfer belt 12*e* are transferred onto the transfer materials S at the secondary transfer part 15 formed by the driving roller 12*f* and the secondary transfer roller 16. After that, the transfer materials S pass through a fixing apparatus 14 that fixes a transfer image and then conveyed to a pair of discharging rollers 20 to be discharged to a transfer material stacking portion.

Here, a feeding apparatus 13 has a sheet feeding roller 9 that feeds the transfer materials S from the sheet feeding cassette 11 in which the transfer materials S are accommodated and a pair of conveyance rollers 10 that conveys the fed transfer materials S. The transfer materials S accommodated in the sheet feeding cassette 11 are brought into contact with the sheet feeding roller 9 by pressurizing, separated one by one by a separation pad 23 (friction piece separation method) and conveyed. Then, the transfer materials S conveyed by the feeding apparatus 13 are conveyed to the secondary transfer part 15 by a pair of resist rollers 17.

A fixing apparatus 14 applies heat and pressure to an image formed on the transfer materials S to be fixed thereon. Reference symbol 14*a* indicates a cylindrical fixing belt, and is guided by a guide member 14*c* to which heating means such as a heater is bonded. Reference symbol 14*b* indicates an elastic pressure roller, and the elastic pressure roller sandwiches the fixing belt 14*a* and forms a fixing nip portion N having a prescribed width at a prescribed pressure welding force with the guide member 14*c*.

Further, as will be described later, the printer 100 serving as an image forming apparatus has a control unit 200 that controls the image forming operation of the printer 100.

Control Unit

Figure 4:
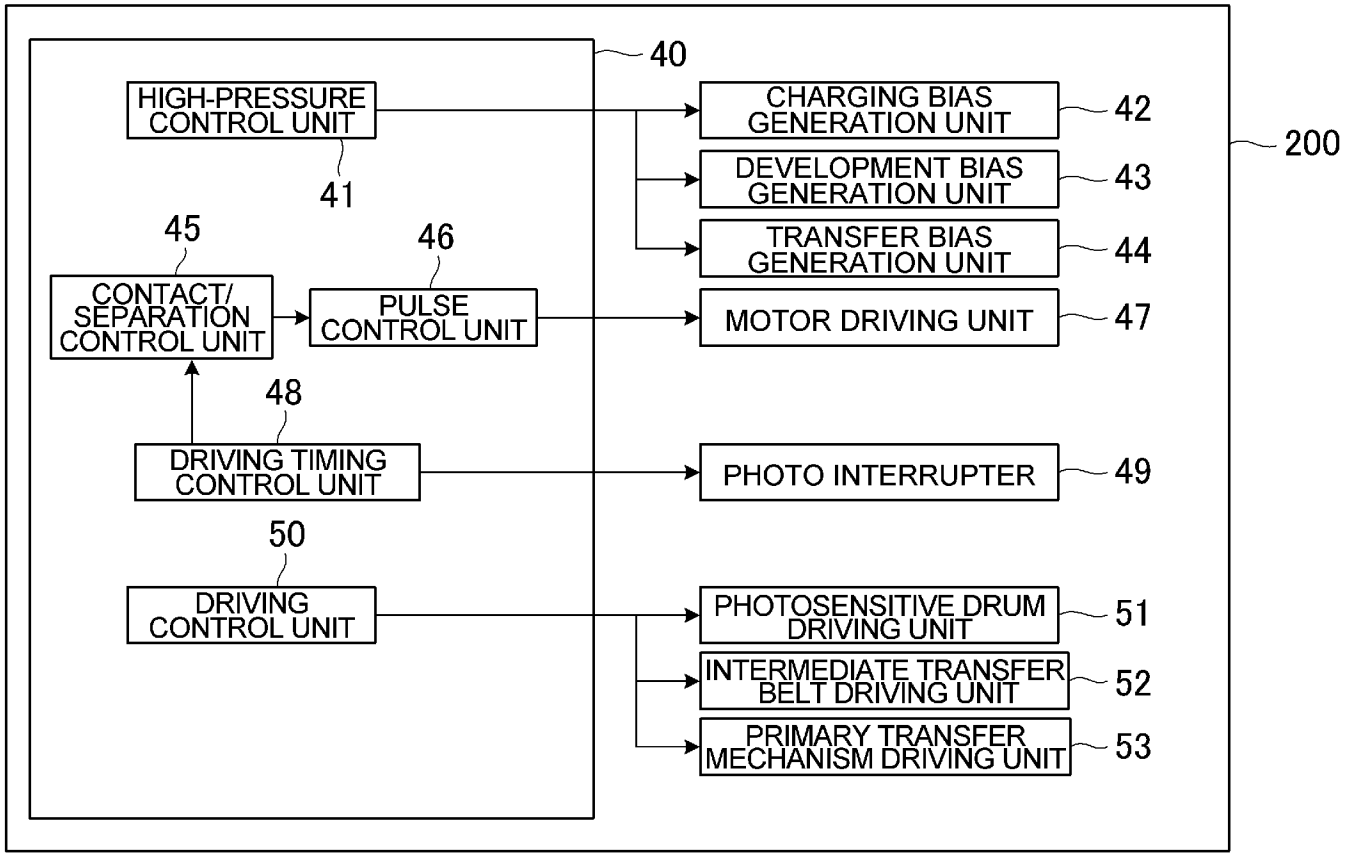
FIG. 4 is a block diagram showing the configuration of the control unit of the image forming apparatus according to the first embodiment of the present invention.

A description will be given, with reference to FIG. 4, of the control unit 200 that controls the image forming operation of the printer 100. FIG. 4 is a block diagram showing the configuration of the control unit 200 of the printer 100 serving as the image forming apparatus according to the embodiment. The printer 100 has the control unit 200 on which an electric circuit that controls the apparatus is mounted, and a CPU 40 is mounted on the control unit 200. The CPU 40 has a driving control unit 50 that conveys the transfer materials S and controls a driving source such as the process cartridge 7, a high-pressure control unit 41 that controls image formation, a contact/separation control unit 45 that controls the contact/separation of the development roller 24, or the like, and collectively controls the operation of the image forming apparatus.

The driving control unit 50 controls a photosensitive drum driving unit 51, an intermediate transfer belt driving unit 52, and a primary transfer mechanism driving unit 53 as driving control during image formation. The high-pressure control unit 41 controls a charging bias generation unit 42 that generates a voltage needed for image formation, a development bias generation unit 43, and a transfer bias generation unit 44. In addition, the control unit 200 has a motor drive IC (motor driving unit) 47 that control the driving of a contact/separation motor (motor) 90 (see FIGS. 5A to 5D) of a development contact/separation mechanism that will be described later. Further, the excitation of the motor 90 is switched when the CPU 40 transmits a pulse signal (two-phase excitation is employed as an excitation system in the embodiment) to the motor drive IC 47.

The motor drive IC 47 having received a pulse signal controls the direction of a current flowing through the coil of the motor 90 corresponding to the pulse signal. On this occasion, a rotor magnet is structured to rotate with the inversion of a filed pole in the motor 90. Note that the rotation speed of the motor 90 depends on the frequency (hereinafter defined as the driving frequency) of the pulse signal transmitted from the CPU 40. The higher the driving frequency, the shorter the inversion cycle of the field pole in the motor 90 becomes and the faster the rotation speed of the motor 90 becomes.

The contact/separation control unit 45 that controls the timing of contact/separation or the like controls the pulse control unit 46 to control the motor 90, and a pulse signal generated by the pulse control unit 46 is transmitted to the motor driving unit (motor drive IC) 47. Further, the signal of a photo interrupter 49 serving as a position detection sensor that will be described later is transmitted to the driving timing control unit 48 and used to control contact/separation. In the embodiment, contact/separation means (FIGS. 5A to 5D to FIGS. 7A to 7D) is used in a transition from development separation to development contact.

Contact/Separation Means

Figures 5A, 5B, 5C, 5D:
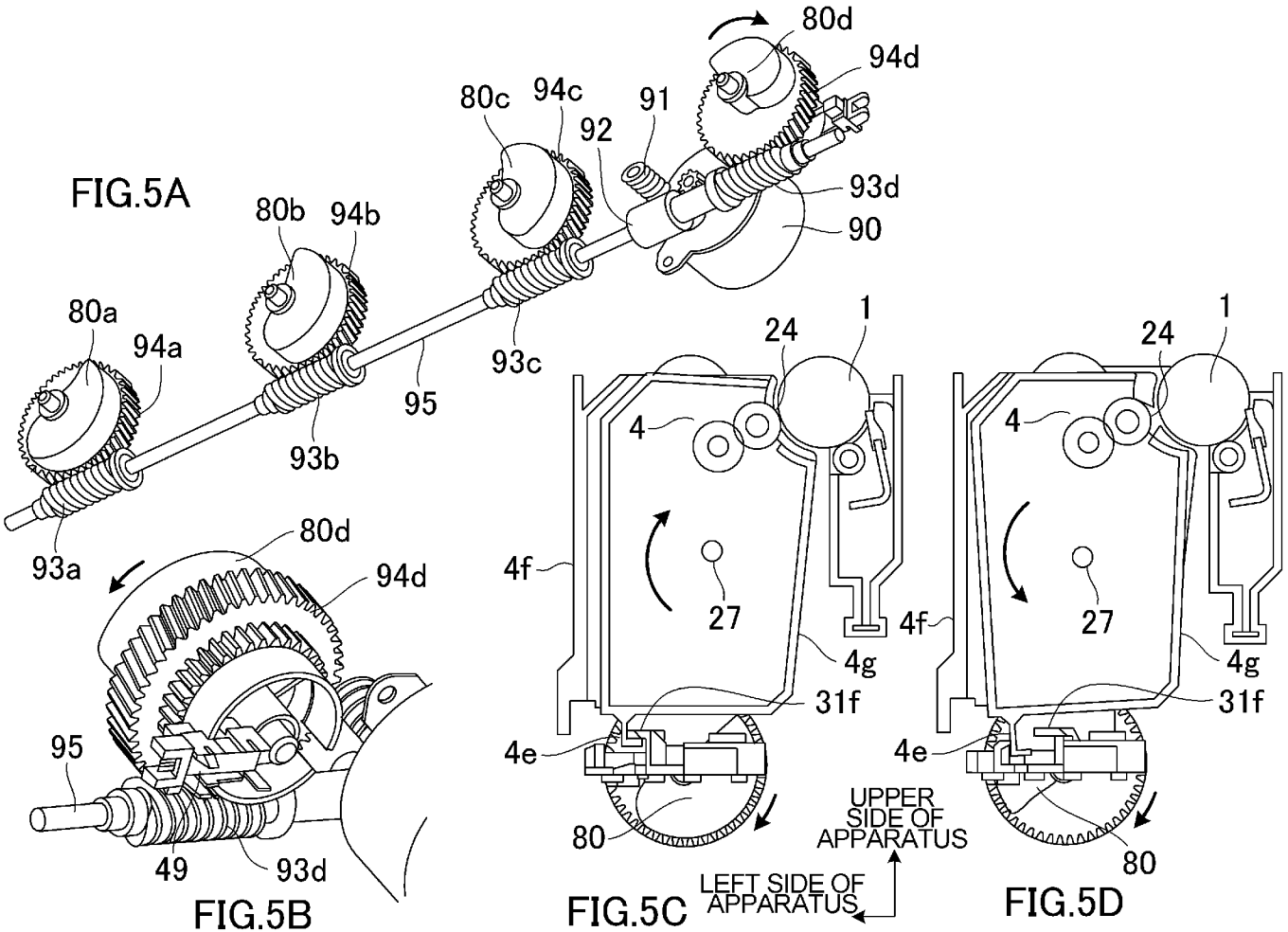
FIGS. 5A to 5D are schematic views for describing the configuration of contact/separation means according to the first embodiment of the present invention.

A description will be given, with reference to FIGS. 5A to 5D to FIGS. 7A to 7D, of the contact/separation means using a transition in which the photosensitive drum 1 and the development roller 24 change from a development contact state to a development separation state as an example. The outline of the transition is as follows. In other words, a first cam 80 rotates about a rotation axis extending in the horizontal direction with the rotation of the motor 90 that drives the contact/separation means. Here, as a link mechanism that interlocks along a horizontal surface (link mechanism constituted by a plurality of members, each of which moves parallel to the horizontal surface), a lever 34, a slider 35, and a pressure spring 32 that biases the development roller 24 to the photosensitive drum 1 are provided. The lever 34 rotates about a rotation axis perpendicular to the horizontal surface, and the slider 35 and the pressure spring 32 are displaced in a direction parallel to the rotation axis of the first cam 80 (in the axis direction of the photosensitive drum 1). Further, with the rotation of a movement member 31 that rotates with the displacement of the slider 35, a rib 31*f* of the movement member 31 separates from a rib 4*e* of the development unit 4 (FIG. 5D). Thus, the photosensitive drum 1 and the development roller 24 change from the development contact state to the development separation state.

Figures 7A, 7B, 7C, 7D:
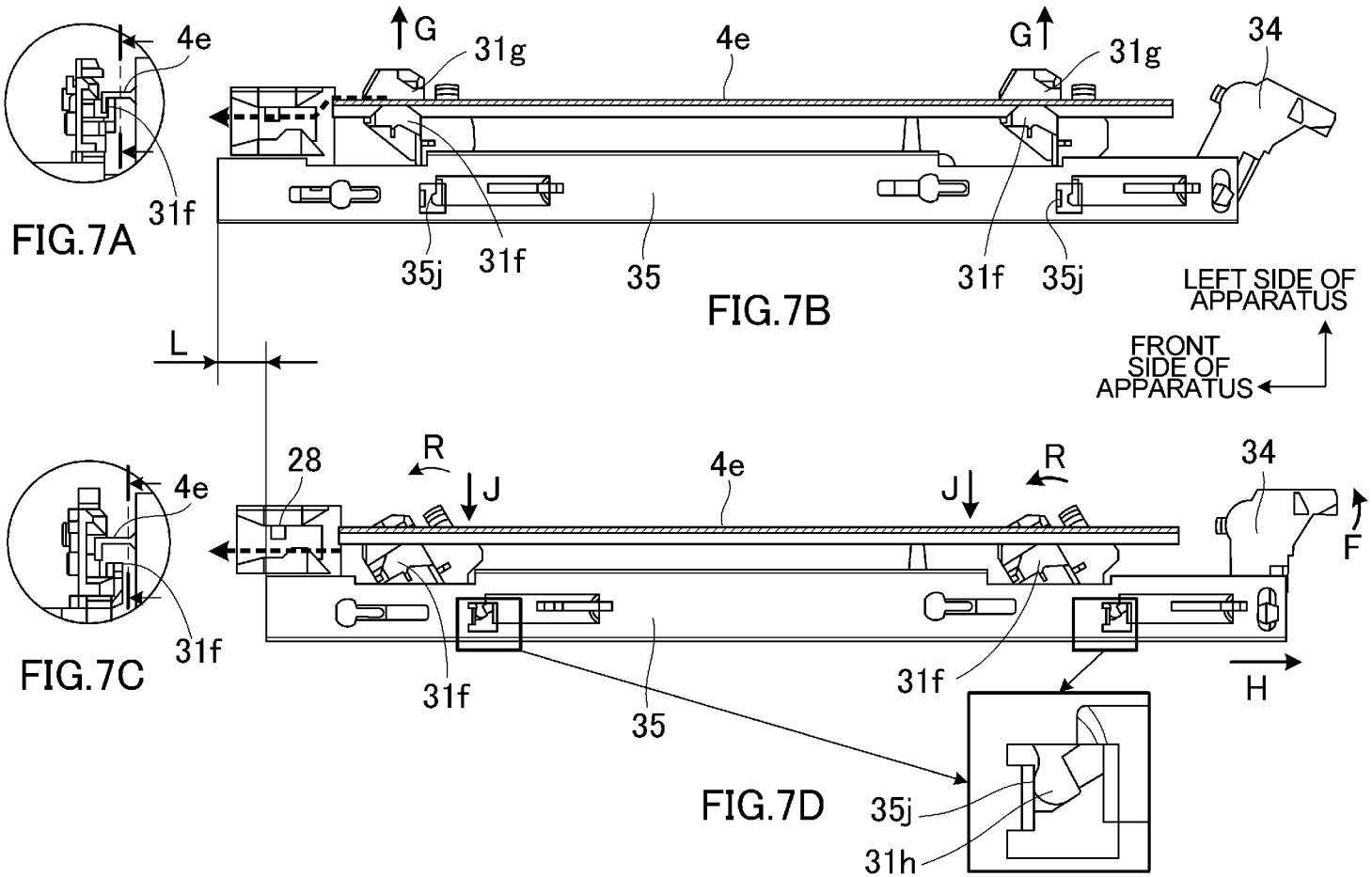
FIGS. 7A to 7D are schematic views for describing the configuration of the contact/separation means according to the first embodiment of the present invention.

More specifically, as shown in FIG. 5A, the lever 34 first swings as indicated by an arrow F in FIG. 7D when the cam radius of a first cam 80 (80*a*, 80*b*, 80*c*, 80*d*) increases with rotation. Then, the slider 35 linearly moves from the front of the apparatus in the rear direction as indicated by an arrow H. Two bended portions 35*j* exist at the contact parts between the pressure spring 32 and the slider 35, and are allowed to contact a rib 31*h* of the movement member 31 (as indicated by the partially enlarged view of FIG. 7D). Therefore, when the slider 35 moves by a constant amount or more, the movement member 31 is caused by the slider 35 to start rotating as indicated by an arrow R in FIG. 7D. Next, the pressure spring 32 is gradually compressed. Then, a rib 31*g* of the movement member 31 moves the rib 4*e* of the development unit 4 from the left side to the right side of the apparatus (as indicated by an arrow J in FIG. 7D).

Next, a description will be given in detail of the contact/separation means for each of FIGS. 5A to 5D, FIGS. 6A to 6D, and FIGS. 7A to 7D.

1) About FIGS. 5A to 5D

FIG. 5A is a perspective view of the driving unit of the contact/separation means, and FIG. 5B is a partially perspective view around the photo interrupter 49 of the driving unit of the contact/separation means. Further, FIG. 5C is a schematic cross-sectional view of the process cartridge and the contact/separation means during development contact, and FIG. 5D is a schematic cross-sectional view thereof during development separation.

A stepping motor is used as the motor 90 serving as a driving source that switches the positions (the contact position and the separation position) of the development roller 24 with respect to the photosensitive drum 1, and is connected to a driving switching shaft (shaft) 95 via gears 91 and 92.

The shaft 95 is provided with a worm gear 93 (93*a*, 93*b*, 93*c*, 93*d*) that drives a cam gear 94 (94*a*, 94*b*, 94*c*, 94*d*) of each color. When the shaft 95 is rotated by the rotation of the motor 90, the cam gear 94 is rotated to change the rotation phase of a first cam 80 (80*a*, 80*b*, 80*c*, 80*d*). The first cam 80 is capable of restricting the positions of the development unit 4 and the development roller 24 via the contact/ separation means shown in FIGS. 6A to 6D that will be described later, and presses the rib 4*e* of the development unit 4 to switch the contact/separation of the photosensitive drum 1 and the development roller 24.

Thus, as shown in FIG. 5A, the shaft 95 and the first cam 80 (80*a*, 80*b*, 80*c*, 80*d*) are rotationally driven by the single motor 90 to make it possible to change the positions (the contact position and the separation position) of the development roller 24 with respect to the photosensitive drum 1. Further, as shown in FIGS. 5C and 5D, the development unit 4 makes it possible to rotate the development container 4*g* about the swinging center pin 27 with respect to the development frame 4*f* while rotatably supporting the development roller 24. Thus, the development roller 24 is biased in a clockwise direction (in a direction in which the development roller 24 contacts the first cam 80) with respect to the photosensitive drum 1 by the pressure spring 32 (FIGS. 6A to 6D) serving as biasing means.

2) About FIGS. 6A to 6D

Figures 6A, 6B, 6C, 6D:
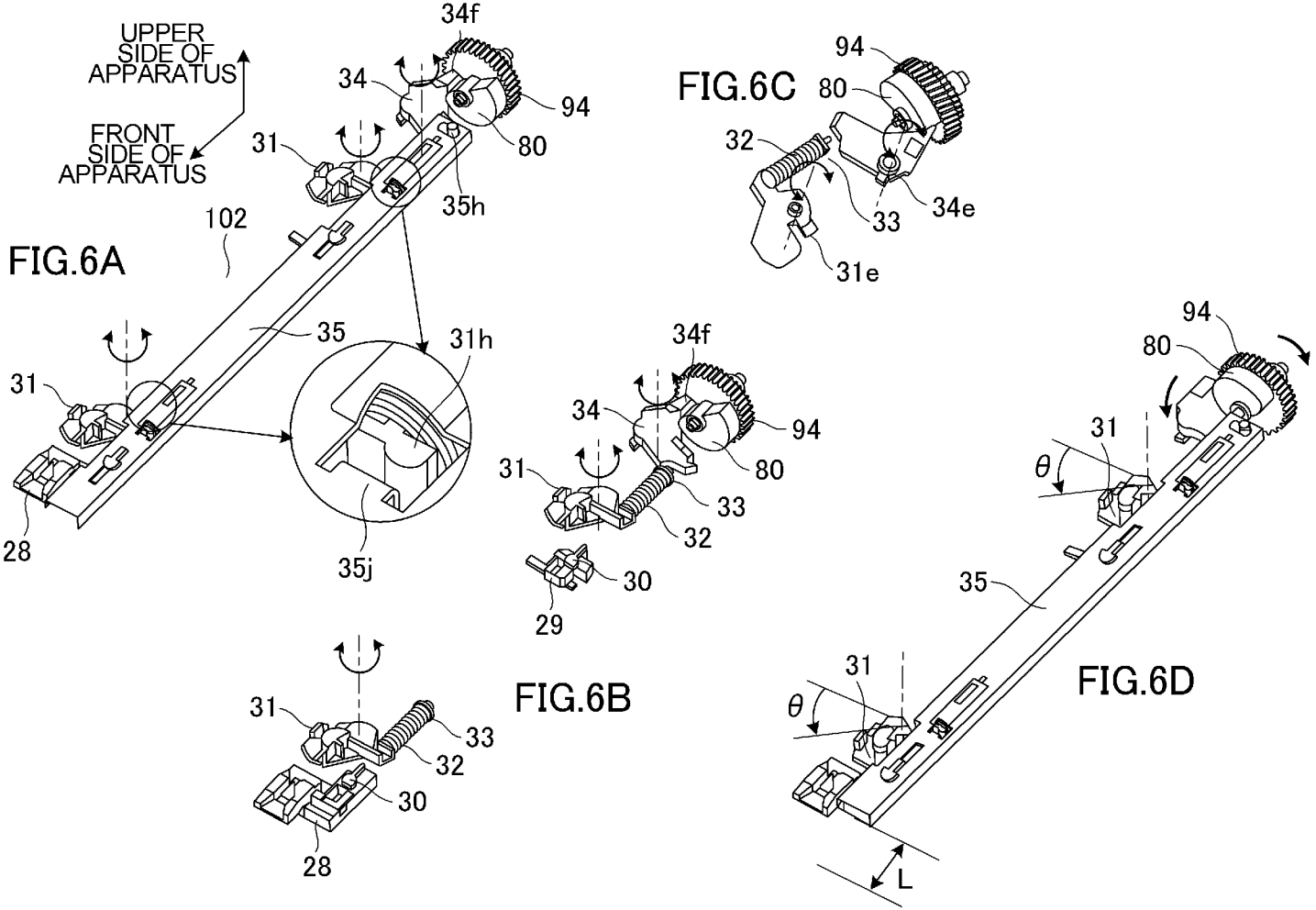
FIGS. 6A to 6D are schematic views for describing the configuration of the contact/separation means according to the first embodiment of the present invention.

FIGS. 6A to 6D are perspective views of the configuration of the contact/separation means that biases the process cartridge 7. FIG. 6A is a perspective view showing the biasing configuration of one station during development contact, and FIG. 6B is a view in which the slider 35 is removed from FIG. 6A for illustrative purposes. Further, FIG. 6C is a view showing the back sides of components on the rear side of the apparatus shown in FIG. 6A, and FIG. 6D is a view showing a configuration during development separation as opposed to the development contact shown in FIG. 6A.

In FIGS. 6A to 6C, a lever 34 that follows the first cam 80 exists. The lever 34 has a boss portion 34*e*, and the boss portion 34*e* is rotatably held by a hole (not shown) provided in a frame 102 (FIG. 2) of the apparatus body. In addition, the lever 34 has another boss portion 34*f* (FIG. 6B), and the boss portion 34*f* is fitted in an oval hole 35*h* (FIG. 6A) of the slider 35.

As shown in FIGS. 6A and 6D, the slider 35 is linearly slidably held in the directions of the front and rear sides of the apparatus by slider guides 28 and 29 (FIG. 6B) fixed to the frame 102. The slider guides 28 and 29 are provided with pins 30 at two places, and the pins 30 prevent the slider 35 from coming off in the upper direction of the apparatus.

Further, as shown in FIG. 6B, a movement member 31, the pressure spring (compression spring) 32, and a spring seat 33 are arranged at two places in the directions of the front and rear sides of the apparatus. The movement member 31 is provided with a boss portion 31*e*, and the boss portion 31*e* is rotatable with respect to the frame 102 like the lever 34. The spring seat 33 is fixed to the frame 102, and the pressure spring 32 is attached to the apparatus body between the movement member 31 and the spring seat 33.

In the embodiment, the lever 34 rotates with the rotation of the first cam 80 from a state shown in FIG. 6A, and the slider 35 moves from the front side to the rear side of the apparatus by an amount L (FIG. 6D). At this time, the movement member 31 rotates by an angle θ shown in FIG. 6D about the boss portion 31*e* with the movement of the slider 35, whereby it becomes possible to change from the development contact state shown in FIG. 5C to the development separation state shown in FIG. 5D. In addition, it becomes possible to reduce the relative difference of the movement member 31 between the front and back sides of the apparatus.

3) About FIGS. 7A to 7D

FIG. 7A is a partially enlarged view of the apparatus when seen from the front side during development contact, and FIG. 7B is a partially enlarged view of FIG. 7A in which the relationship between the contact/separation means and the rib 4*e* of the development unit 4 is shown from the upper side of the apparatus. FIGS. 7C and 7D are views showing the relationship between the contact/separation means and the rib 4*e* of the development unit 4 like FIGS. 7A and 7B during development separation.

During the development contact, the rib 31*f* of the movement member 31 biases the rib 4*e* of the development unit 4 at two places in the direction of the front side of the apparatus as indicated by an arrow G in FIG. 7B with the elastic force of the pressure spring 32. Thus, the development roller 24 contacts the photosensitive drum 1.

On the other hand, during the development separation (standby state), the rib 31*f* of the movement member 31 separates from the rib 4*e* of the development unit 4 at two places in the front-back direction of the apparatus as indicated by an arrow J in FIG. 7D with the compression of the pressure spring 32. Thus, the development roller 24 separates from the photosensitive drum 1.

A description will be given, with reference to FIGS. 8A and 8*b* to FIG. 11, of the configuration of biasing and positioning the process cartridge with respect to the frame 102 with the opening and closing of the access door 101 serving as an opening/closing member.

Figure 8A:
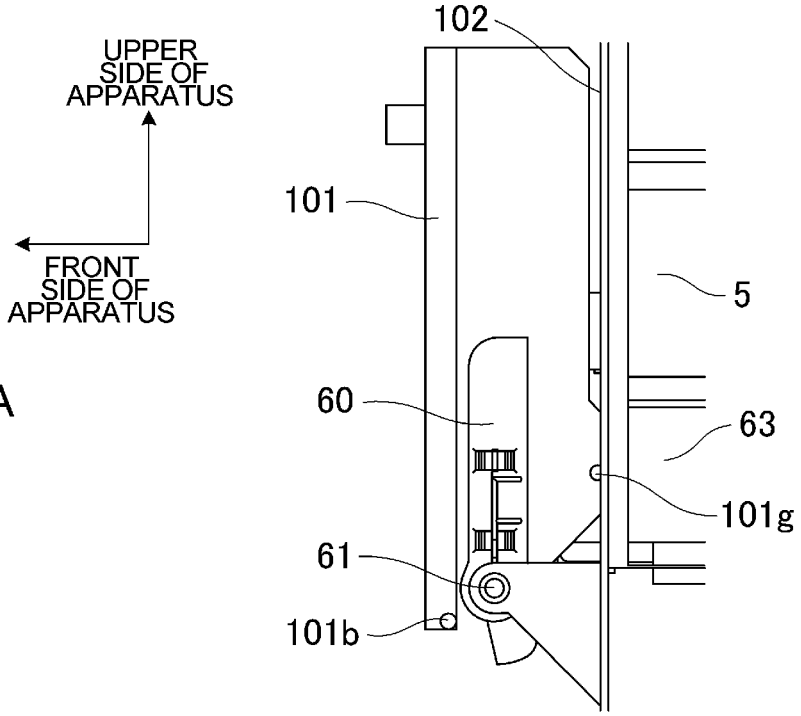
FIGS. 8A and 8B are schematic views for describing the opening/closing operation of an access door according to the first embodiment of the present invention.
Figure 8B:
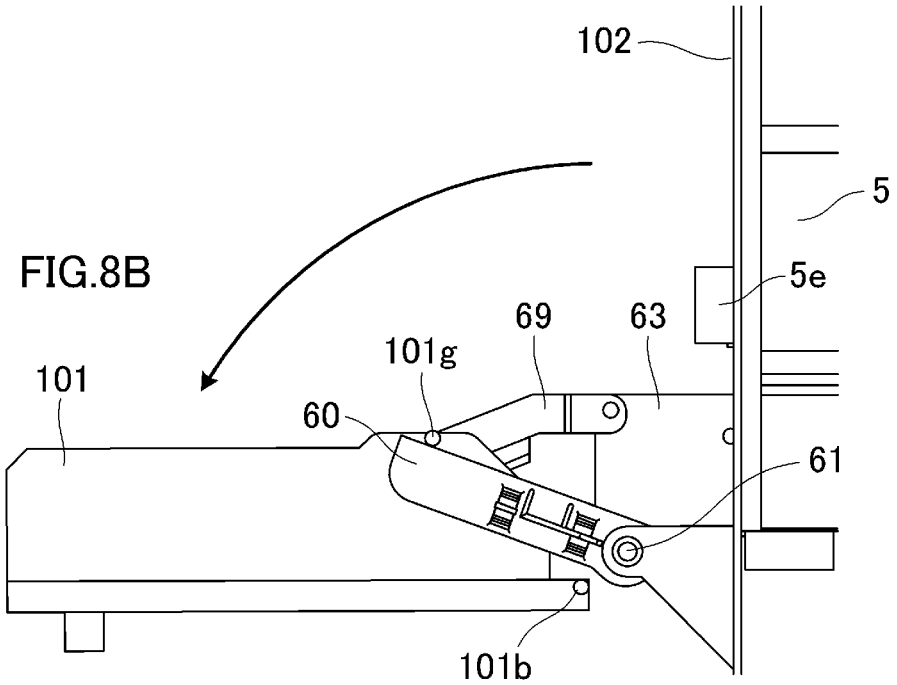

1) About FIGS. 8A and 8B

FIGS. 8A and 8B are partially enlarged cross-sectional views showing the access door 101, the process cartridge 7, and the periphery of a guide rail 63 of the process cartridge 7 in a surface orthogonal to the horizontal surface (right-left direction). FIGS. 8A and 8B show the opening/closing operation of the access door 101 and the positional relationship of the process cartridge 7 or the like. FIGS. 8A and 8B are views of the apparatus when seen from the right side, FIG. 8A showing a state in which the access door 101 is put in a closed position where space, which is provided in the apparatus body and in which the process cartridge 7 is accommodated, is closed, FIG. 8B showing a state in which the access door 101 is put in an open position where the space for accommodating the process cartridge 7 is open in the apparatus body.

The frame 102 (FIG. 2) has a shaft 61 with its both ends rotatably supported, and an interlocking lever 60 is fixed to the shaft 61. The access door 101 has a rotation shaft 101*b*, and the rotation shaft 101*b* serves as the rotation supporting point of the access door 101. The access door 101 is provided with an engagement boss 101*g*, and the engagement boss 101*g* engages the interlocking lever 60 when the access door 101 changes from the closed state to the open state. Further, the shaft 61 rotates by a desired angle in a direction as indicated by a solid line in FIG. 8B with the opening of the access door 101.

Figures 9A, 9B, 9C:
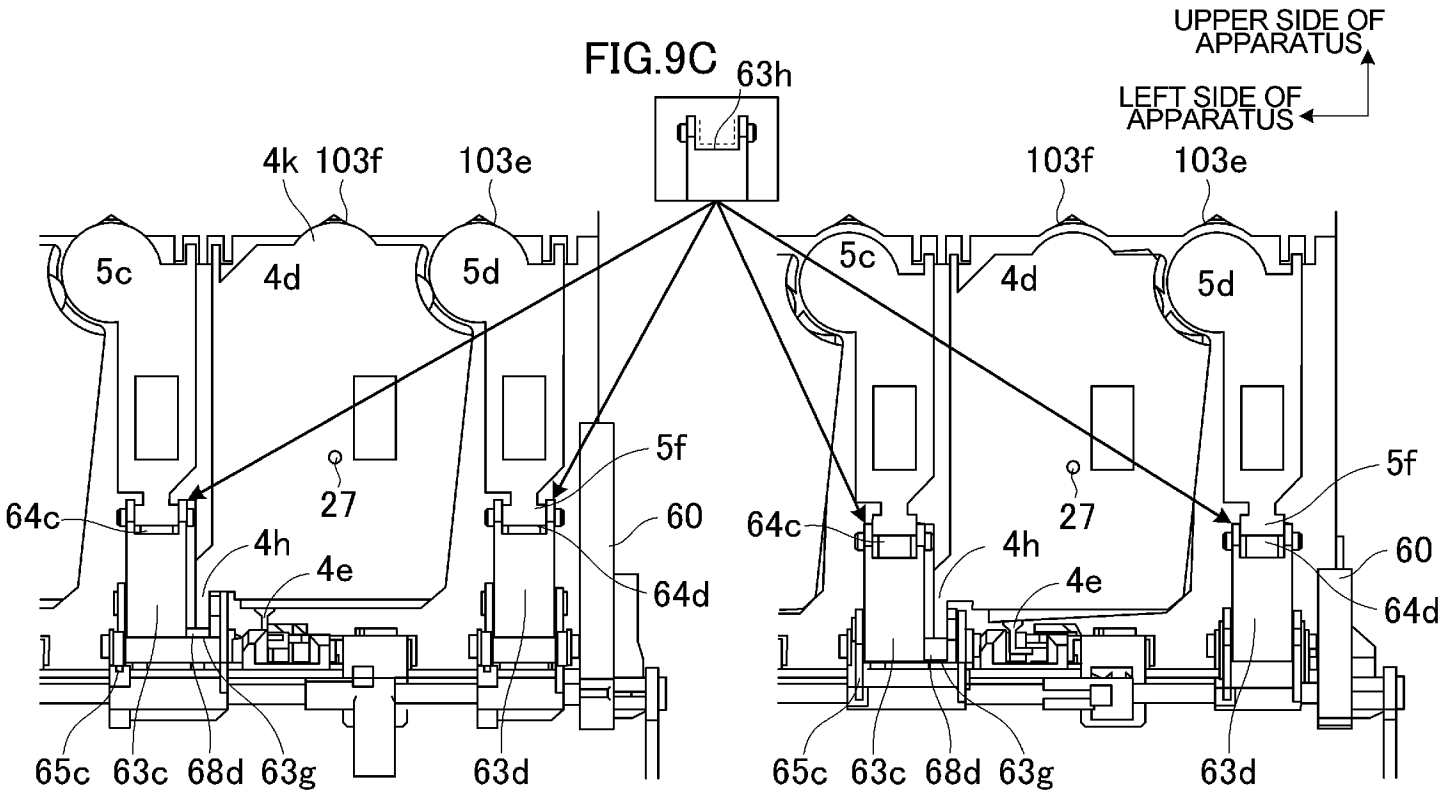
FIGS. 9A and 9B are schematic views for describing the opening/closing operation of the access door according to the first embodiment of the present invention.
FIG. 9C is a partially enlarged view of a shape in the vicinity of a drum guide portion.

2) About FIGS. 9A to 9C

FIGS. 9A and 9B are enlarged views of the front side of a K-station in a surface orthogonal to the horizontal surface (in the front-back direction of the apparatus), FIG. 9A showing a state in which the access door 101 is closed, FIG. 9B showing a state in which the access door 101 is open. FIG. 9C is a partially enlarged view of a shape in the vicinity of a drum guide portion 63*h* having only the rail 63.

A lower portion 5*f* of the drum unit 5 of the cartridge 7 is formed into a substantially T-shape and fitted in the drum guide portion 63*h* having a substantially U-shaped cross section as indicated by broken lines in FIG. 9C. Further, the upper portion of the drum unit 5 has an arc shape at its supporting portion that supports both ends of the photosensitive drum 1, and the arc shape is positioned with respect to a V-shape 103*e* of an upper frame. The biasing of the V-shape 103*e* is performed by a pressing member 64 (64*a*, 64*b*, 64*c*, 64*d*) arranged inside guide rail 63 (63*a*, 63*b*, 63*c*, 63*d*). Thus, the process cartridge 7 is biased to the upper side of the apparatus when the access door 101 is closed. For the development unit 4, a rib 4*h* of the development frame 4*f* is fitted in a development guide portion 63*g* of the substantially U-shaped groove of the guide rail 63, and an upper arc shape 4*k* of the development frame 4*f* is positioned with respect to the V-shape 103*f* of the upper frame.

In the embodiment, in order to save the space of the apparatus and secure the rigidity of the guide rail 63 itself, the guide rail 63 is so configured that the drum guide portion 63*h* and the development guide portion 63*g* are integrally formed. In the image forming apparatus, the cartridges 7 (7*a*, 7*b*, 7*c*, 7*d*) corresponding to the respective colors yellow (Y), magenta (M), cyan (C), and black (K) are arranged one by one to be adjacent to each other. Each of the cartridges 7 has the drum unit 5 having the photosensitive drum 1 and the development unit 4 having a container (first container) in which a developer is accommodated besides the development roller 24 that develops, with the developer, an electrostatic latent image formed on the photosensitive drum 1 of the drum unit 5. In the guide rail 63 of the embodiment, the drum guide portion 63*h* that guides the drum unit 5 of one of adjacent two cartridges 7 and the development guide portion 63*g* that guides the development unit 4 of the other cartridge 7 are integrated with each other. However, the shape of the guide rail 63 is not limited to this, and the guide rail 63 may be replaced by a rail member in which the drum guide portion 63*h* and the development guide portion 63*g* are separated from each other.

A drum guide portion (first guide portion) 63*h* of the guide rail 63 is provided at a position higher than that of the development guide portion (second guide portion) 63*g*. Thus, since the drum unit 5 may be downsized in its height direction, a reduction in the storage space of user's replacement units is achieved. In addition, since the development unit 4 may be upsized in its height direction compared with the drum unit 5, an increase in the capacity of contained toner is made possible.

When the access door 101 is open, the biasing of the cartridge to the V-shapes 103*e* and 103*f* is released. Thus, it becomes possible to extract the cartridge 7 from the apparatus body in the development separation state while reducing an operating force.

Figure 10A:
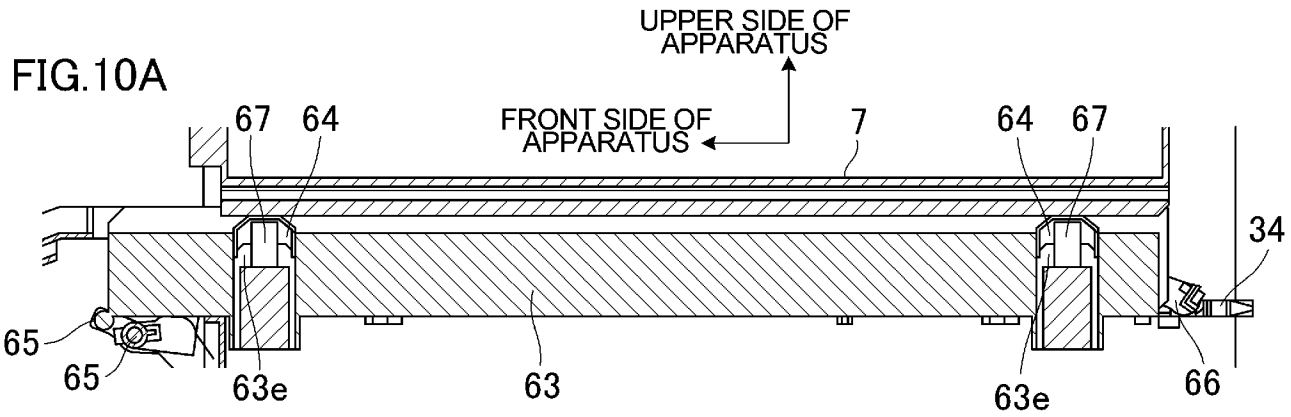
FIGS. 10A and 10B are schematic views for describing the relationship between a guide rail and the access door according to the first embodiment of the present invention.
Figure 10B:
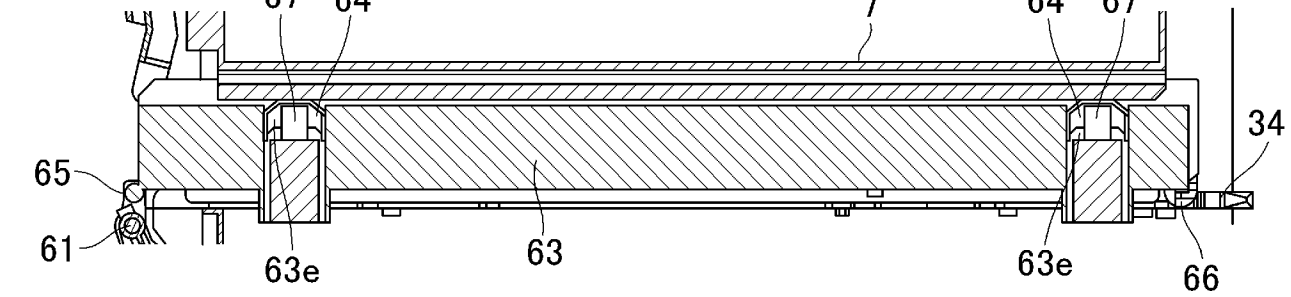

3) About FIGS. 10A and 10B

FIGS. 10A and 10B are schematic views showing the relationship between the guide rail 63 and the access door 101 in a surface orthogonal to the horizontal surface (in the right-left direction of the apparatus). FIG. 10A shows a state in which the access door 101 is open, and FIG. 10B shows a state in which the access door 101 is closed.

The guide rail 63 has pressing member accommodation portions 63*e* at two places in the front-back direction of the apparatus. Biasing members (compression springs) 67 are provided between the pressing member accommodation portions 63*e* and pressing members 64, and the pressing members 64 are configured to bias the cartridge 7 to the upper side of the apparatus with respect to the guide rail 63.

Further, the guide rail 63 is connected to the shaft 61 via a rail arm 65 (65*a*, 65*b*, 65*c*, 65*d*), and connected to a frame not shown via a rail arm 66 on the rear side of the apparatus to form a four-joint parallel link as a link mechanism. Further, a tensile spring not shown is provided between the guide rail 63 and the frame, and the guide rail 63 is biased so as to change from a state shown in FIG. 10B to a state shown in FIG. 10A. Thus, it becomes possible to elevate and bias the guide rail 63 and the process cartridge 7 with the opening/closing operation of the access door 101.

Figure 11:
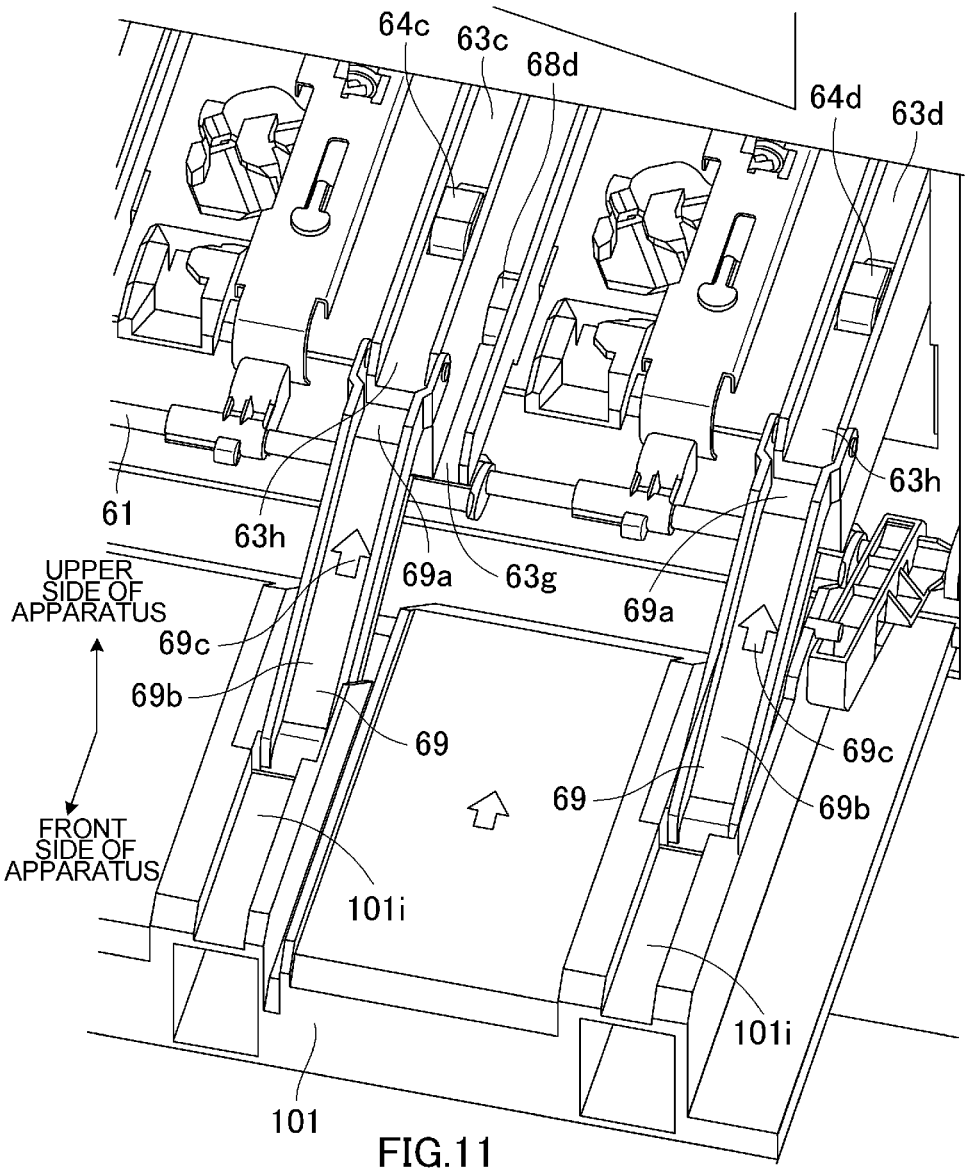
FIG. 11 is a perspective view showing the configurations of the guide rail and a shaft or the like operating with the access door according to the first embodiment of the present invention.

4) About FIG. 11

FIG. 11 is a partially perspective view showing the configurations of guide rails 63*c* and 63*d* corresponding to cyan (C) and black (K), respectively, and the shaft 61. As described above, a pressing member 68*d* that presses the rib 4*h* of the development frame 4*f* is provided on the guide rail 63*c* with respect to the development unit 4. The pressing member 68*d* is biased to the upper side of the apparatus by biasing members (compression springs) like the pressing member 64 for the drum unit 5 (see FIGS. 10A and 10B).

Slope Member

Figure 12A:
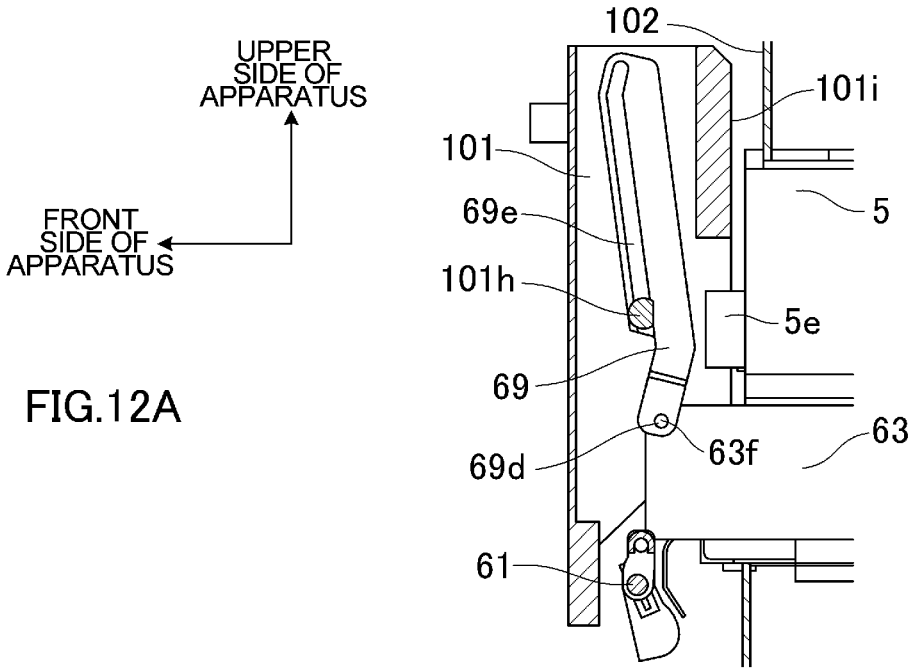
FIGS. 12A and 12B are partially cross-sectional views for describing the configuration of a slope member according to the first embodiment of the present invention.
Figure 12B:
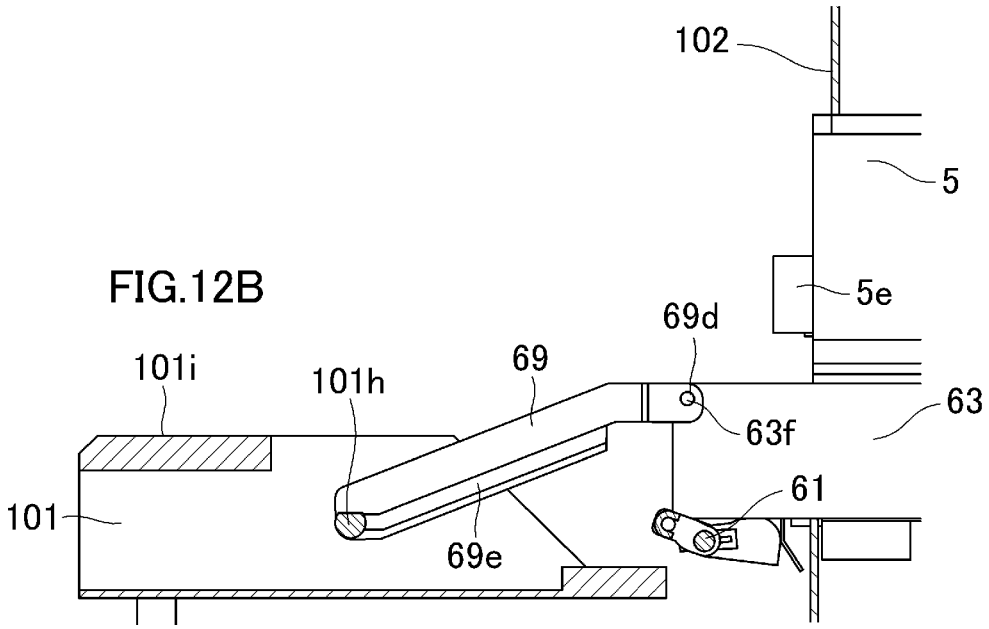

A description will be given, with reference to FIG. 11 and FIGS. 12A and 12B, of the configuration of a slope member 69 in the embodiment. FIGS. 12A and 12B are partially cross-sectional views of the vicinity of the slope member 69 in a surface orthogonal to the right-left direction of the apparatus, FIG. 12A showing a state in which the access door 101 is closed, FIG. 12B showing a state in which the access door 101 is open.

The slope member 69 is coupled to the guide rail 63 (63*a* to 63*d*), the frame 102 of the apparatus body via the guide rail 63, and the access door 101. The slope member 69 has an engagement hole 69*d* engaging an engagement boss 63*f* provided on the guide rail 63, and is rotatably supported about the engagement hole 69*d* with respect to the guide rail 63. In addition, the slope member 69 has an engagement groove 69*e* engaging an engagement boss 101*h* provided on the access door 101 with respect to the access door 101, and is supported so as to be capable of changing its posture with respect to the access door 101 when the engagement boss 101*h* slides inside the engagement groove 69*e*. That is, the slope member 69 is configured to be capable of changing its posture with respect to the access door 101 so as to shift its connecting position with the access door 101 while changing its angle with respect to the access door 101. Moreover, the access door 101 and the apparatus body are capable of accommodating the slope member 69 in space in which the process cartridge 7 is accommodated. The slope member 69 changes its posture with respect to the access door 101 so as to be accommodated in the above space while reducing its angle with respect to the access door 101 when the access door 101 moves from an open position to a closed position. Thus, when the access door 101 is put in the closed position, the slope member 69 is positioned inside the access door 101 in the inserting/extracting direction of the unit.

As shown in FIG. 12A, the slope member 69 is stored so as to get into the inside (accommodation portion) of the access door 101 when the access door 101 is closed. Therefore, it is possible to arrange the slope member 69 in small space without increasing a product size in the front direction of the apparatus. Further, as shown in FIG. 11 and FIG. 12B, the slope member 69 protrudes in the front direction of the apparatus together with the access door 101 when the access door 101 is open. Further, the access door 101 is provided with a guide portion 101*i* serving as a third guide portion. Outside the space of the apparatus body in which the process cartridge 7 is accommodated, the guide portion 101*i* guides the unit in the inserting/extracting direction at a position lower than that of the guide rail 63 serving as the first guide portion in a height direction orthogonal to the inserting/extracting direction of the unit.

The slope member 69 has, on its upper surface, a flat surface portion 69*a* serving as an end on a side close to the first guide portion (on a downstream side in an attachment direction) and an inclined surface portion 69*b*. The inclined surface portion 69*b* guides the unit in a direction inclined with respect to the inserting/extracting direction (horizontal direction) of the unit. The flat surface portion 69*a* has substantially the same height as that of the drum guide portion 63*h* of the guide rail 63. The height of the inclined surface portion 69*b* at one end (upstream side) on the front side of the apparatus is lower than that of the guide portion 101*i* provided on the access door 101. The other end (downstream side) of the inclined surface portion 69*b* is smoothly connected to the flat surface portion 69*a*. Thus, the slope member 69 is, when the access door 101 is put in the open position, capable of guiding the drum unit 5 to the development guide portion 63*g* provided at a position higher than that of the drum guide portion 63*h* in the height direction orthogonal to the inserting/extracting direction. Note that the flat surface portion may be provided at an end on a side close to the second guide portion. Walls are provided on both ends of the guide portion 101*i*, the inclined surface portion 69*b*, and the flat surface portion 69*a*, and the width between the walls is substantially the same as that of the lower portion 5*f* of the drum unit 5 (5*a*, 5*b*, 5*c*, 5*d*). Here, the position of the slope member 69 in the right-left direction of the apparatus when seen from the front side of the apparatus is substantially below the gravity position of the drum unit 5. Therefore, the drum unit 5 is prevented from falling down in the right-left direction of the apparatus when the drum unit 5 is inserted.

When inserting the drum unit 5 in the apparatus body, a user picks up the handle portion 5*e* and puts the tip end in the inserting direction of the lower portion 5*f* in the guide portion 101*i* and then causes the lower portion 5*f* to pass through the guide portion 101*i*, the inclined surface portion 69*b*, the flat surface portion 69*a*, and the drum guide portion 63*h* in this order. Therefore, since the drum unit 5 is inserted from a lower position compared with a state in which the photosensitive drum 1 (1*a* to 1*d*) is attached inside the apparatus, it becomes possible to attach the drum unit 5 without damaging the surface of the photosensitive drum 1.

When extracting the drum unit 5 attached to the apparatus body, the user picks up the handle portion 5*e* and then causes the lower portion 5*f* to pass through the drum guide portion 63*h*, the flat surface portion 69*a*, the inclined surface portion 69*b*, and the guide portion 101*i* in this order. At this time, since the drum guide portion 63*h* and the guide portion 101*i* have a flat surface, it becomes possible to prevent the drum unit 5 from being extracted with a great force and extract the drum unit 5 while preventing the same from coming off.

The inclined surface portion 69*b* is provided with an arrow-shaped engraved mark serving as an insertion instructing portion (display portion) 69*c*. By inserting the drum unit 5 in a direction as indicated by the insertion instructing portion 69*c*, it becomes possible for the user to perform the smooth insertion of the drum unit 5.

According to the embodiment, it is possible to prevent the occurrence of damage such as a scratch on the surface of a photosensitive drum during the insertion of a cartridge and achieve an improvement in usability and maintenance while reducing the upsize of a product and an increase in the costs of the process cartridge.

The access door 101 needs to support its weight as a guide when the cartridge 7 (7*a* to 7*d*) is inserted/extracted. In the embodiment, each of the plurality of slope members 69 is supported by the engagement boss 63*f* and the engagement boss 101*h*. Therefore, the single access door 101 is configured to be suspended and reinforced by the four slope members 69 with respect to the frame 102 of the apparatus body. Therefore, it becomes possible to support the weight of the cartridge 7 without additionally providing a suspending member even if the strength of the access door 101 is low.

Modified Example of Embodiment

In the embodiment, the insertion instructing portion 69*c* of the slope member 69 is the arrow-shaped engraved mark that instructs the inserting direction. However, a label, print, or the like may be used instead of the arrow-shaped engraved mark, and a display portion that displays an extracting direction instead of the inserting direction may be used. In addition, instead of the arrow-shape engraved mark, characters or shapes such as "DRUM" indicating the drum unit 5, color information such as YMCK, the station numbers of cartridges, or the like may be expressed or described in combination. That is, a display portion that displays a unit to be guided may be provided. In order to differentiate the slope member 69 from the access door 101 and make the inserting/extracting guide of the drum unit 5 conspicuous for the user, the component colors of the access door 101 and the slope member 69 may be different from each other. Although the same components are commonly used in the four slope members 69 to improve costs and assembling performance, other components may be used to realize these purposes.

In addition, in the embodiment, the cartridge 7 divided into the two bodies of the development unit 4 and the drum unit 5 is used to reduce the storage space for user's replacement units with the commonization of the drum unit 5 between the four stations. However, the cartridge 7 may have other shapes. For example, the cartridge 7 in which the development unit 4 and the drum unit 5 are constituted by one body may be used. In this case, the guide portion 101*i* of the access door 101, the flat surface portion 69*a* of the slope member 69, the inclined surface portion 69*b*, and the drum guide portion 63*h* of the guide rail 63 may guide the insertion/extraction of the cartridge 7.

In the embodiment, the access door 101 that opens/closes the opening portion of the apparatus body serves also as the exterior of the apparatus body. However, with an exterior door additionally provided, the access door 101 may serve as a door inside the apparatus body. In this case, the slope member 69 may be configured to operate with the opening/closing of the access door 101 inside the apparatus body.

Second Embodiment

Next, a description will be given of a second embodiment of the present invention. The first embodiment provides the configuration having the guide rail 63 having the guide portions different in height when the access door 101 is open, the configuration having the slope member 69 that couples the guide portion 101*i* of the access door 101 and the drum guide portion 63*h* of the guide rail 63 to each other. However, the configuration may not have the slope member 69. Hereinafter, a description will be given of the second embodiment that does not have the slope member 69. Note that in the second embodiment, the same configurations as those of the first embodiment such as the entire configuration of an image forming apparatus will be denoted by the same symbols and their descriptions will be omitted.

Figure 13:
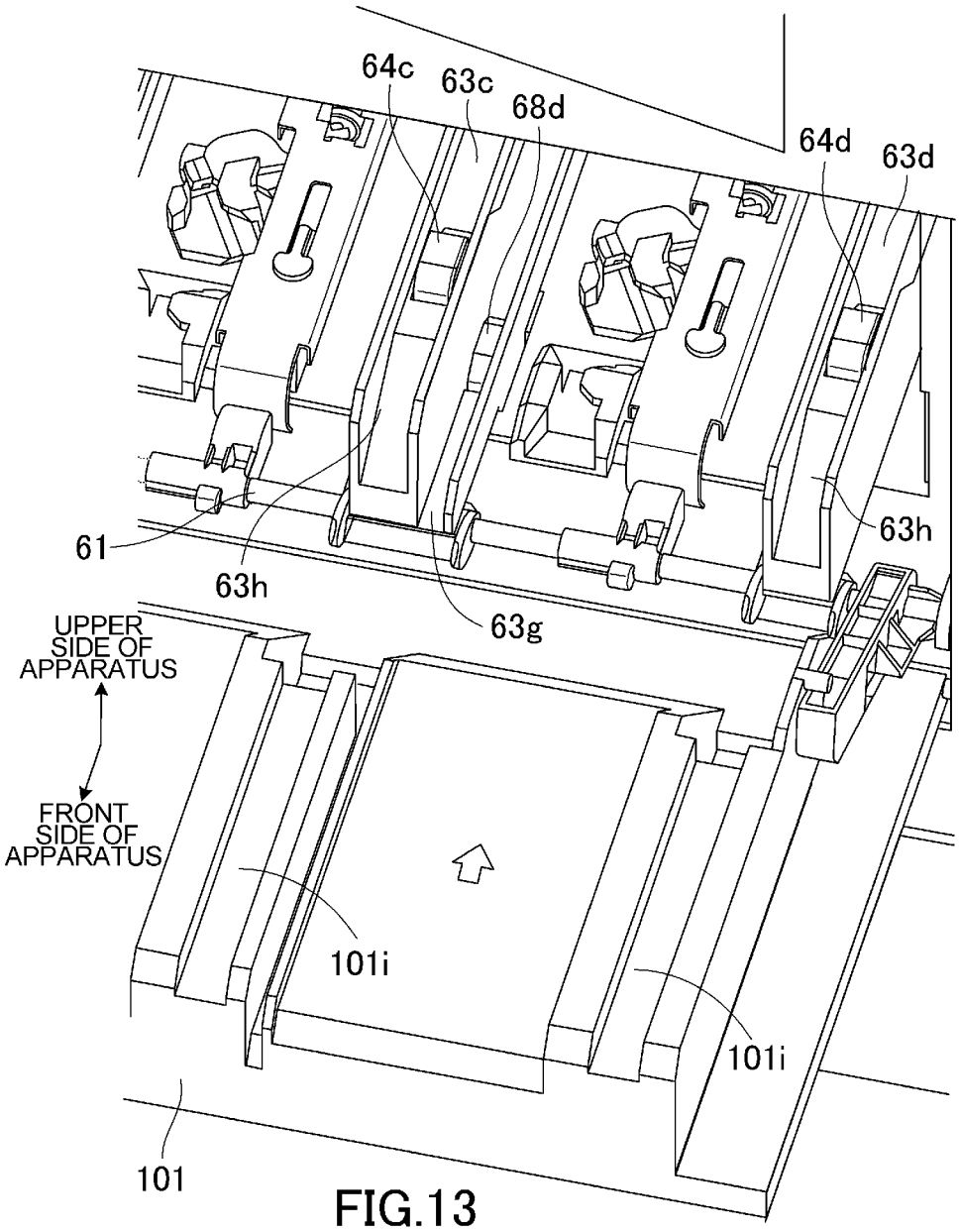
FIG. 13 is a perspective view showing the configurations of a guide rail and a shaft or the like operating with an access door according to a second embodiment of the present invention.
Figure 14:
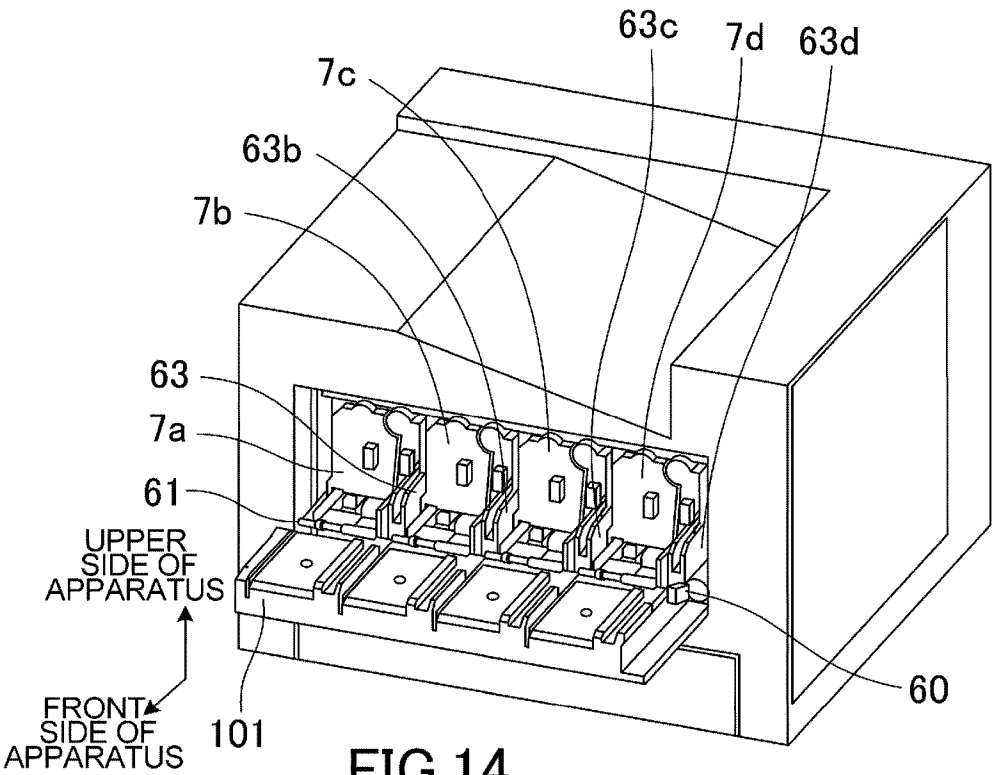
FIG. 14 is a schematic perspective view of an image forming apparatus according to the second embodiment of the present invention.

A description will be given, with reference to FIGS. 13 and 14, of the configuration of a guide rail 63 according to the second embodiment. In the embodiment, a drum guide portion 63*h* of the guide rail 63 is provided at a position higher than that of a development guide portion 63*g* in a vertical direction like the first embodiment. That is, the drum guide portion 63*h* corresponding to a drum unit 5 and a development guide portion 63*g* corresponding to a development unit 4 are provided at different heights in the vertical direction. Thus, a user is allowed to avoid mixing up the drum unit 5, the development unit 4, and the guide portions corresponding to the drum unit 5 and the development unit 4 and erroneously attaching the drum unit 5 and the development unit 4. As a result, damage on the surface of a photosensitive drum and the surface of a development roller may be prevented during the insertion of a cartridge. Further, according to the configuration of the embodiment, storage space for replacement units may be reduced since the drum unit 5 is downsized in its height direction. In addition, since the development unit 4 may be upsized in its height direction compared with the drum unit 5, it is possible to achieve an increase in the capacity of toner in a development container.

Note that in the embodiment, an inclined portion is provided at an upstream-side end in the inserting direction of the drum guide portion 63*h* instead of the slope member 69 of the first embodiment. The inclined portion is provided so as to be inclined to move upward from below the apparatus body from an upstream side to a downstream side in the inserting direction. Thus, the configuration is made simpler, and the drum unit 5 placed on a guide portion 101*i* may be stably smoothly inserted in the drum guide portion 63*h*.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-214489, filed on Nov. 1, 2016, and Japanese Patent Application No. 2017-179418, filed on Sep. 19, 2017, which are hereby incorporated by reference herein in their entirety.

What is claimed is:

1. An image forming apparatus, comprising:

a drum cartridge that includes a photosensitive drum configured to bear a toner image and to be rotatable about a rotational axis;

a developing cartridge that includes a developing roller configured to supply toner to the photosensitive drum; and an apparatus main body to which the drum cartridge and the developing cartridge are independently and detachably mountable in a direction of the rotational axis, the apparatus main body including:

an opening through which the drum cartridge and the developing cartridge pass when being mounted to the apparatus main body;

a cover configured to move between an open position where the cover does not cover the opening and a closed position where the cover covers the opening;

a first guide configured to guide the drum cartridge and to support the drum cartridge from below, the first guide extending in the direction of the rotational axis;

a second guide configured to guide the developing cartridge and to support the developing cartridge from below, the second guide extending in the direction of the rotational axis and being arranged at a positon lower than that of the first guide, the second guide overlapping with the first guide when viewed in a direction orthogonal to the rotational axis; and a slope guide configured to guide the drum cartridge toward the first guide and to support the drum cartridge from below, the slope guide having a slope upwardly inclined toward the first guide.

2. The image forming apparatus according to claim 1, wherein the cover includes a third guide configured to guide the drum cartridge toward the slope guide and to support the drum cartridge from below when the cover is in the open position, the third guide being arranged at a position lower than that of the first guide.

3. The image forming apparatus according to claim 2, wherein the slope of the slope guide is upwardly inclined from a position lower than the third guide.

4. The image forming apparatus according to claim 1, wherein the apparatus main body includes an intermediate transfer unit to which the toner image is transferred from the photosensitive drum, and wherein the drum cartridge and the developing cartridge are arranged at positons lower than that of the intermediate transfer unit.

5. The image forming apparatus according to claim 1, wherein the slope guide includes first and second engaging portions engaging with a first engaged portion of the first guide and a second engaged portion of the cover, respectively.

6. The image forming apparatus according to claim 5, wherein an engaging position between the second engaging portion of the slope guide and the second engaged portion of the cover is capable of shifting in conjunction with a movement of the cover from the open position to the closed position, so that a posture of the slope guide with respect to the cover in a case where the cover is in the closed position is different from that in a case where the cover is in the open position, for accommodating the slope guide inside the apparatus main body when the cover is in the closed position.

7. The image forming apparatus according to claim 1, wherein the slope guide includes a flat surface downstream of the slope in a direction in which the drum cartridge is mounted to the apparatus main body, the flat surface being arranged at the same height as the first guide.

8. An image forming apparatus, comprising:

a cartridge that includes a rotating member rotatable about a rotational axis;

an apparatus main body to which the cartridge is detachably mountable in a direction of the rotational axis, the apparatus main body including:

an opening through which the cartridge passes when being mounted to the apparatus main body;

a cover configured to move between an open position where the cover does not cover the opening and a closed position where the cover covers the opening;

a first guide configured to guide the cartridge and to support the cartridge from below, the first guide extending in the direction of the rotational axis; and a slope guide configured to guide the cartridge toward the first guide and to support the cartridge from below, the slope guide having a slope upwardly inclined toward the first guide, wherein the cover includes a second guide configured to guide the cartridge toward the slope guide and to support the cartridge from below when the cover is in the open position, the second guide being arranged at a position lower than that of the first guide.

9. The image forming apparatus according to claim 8, wherein the slope of the slope guide is upwardly inclined from a position lower than the second guide.

10. The image forming apparatus according to claim 8, wherein the slope guide includes first and second engaging portions engaging with a first engaged portion of the first guide and a second engaged portion of the cover, respectively.

11. The image forming apparatus according to claim 10, wherein an engaging position between the second engaging portion of the slope guide and the second engaged portion of the cover is capable of shifting in conjunction with a movement of the cover from the open position to the closed position, so that a posture of the slope guide with respect to the cover in a case where the cover is in the closed position is different from that in a case where the cover is in the open position, for accommodating the slope guide inside the apparatus main body when the cover is in the closed position.

* * * * *